US011614260B2

(12) United States Patent
Saito et al.

(10) Patent No.: US 11,614,260 B2
(45) Date of Patent: Mar. 28, 2023

(54) HEAT EXCHANGER FOR HEAT PUMP APPLICATIONS

(71) Applicant: Carrier Corporation, Palm Beach Gardens, FL (US)

(72) Inventors: Kazuo Saito, Glastonbury, CT (US); Arindom Joardar, Jamesville, NY (US); Robert A. Leffler, Salt Lake City, UT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 507 days.

(21) Appl. No.: 16/611,123

(22) PCT Filed: May 4, 2018

(86) PCT No.: PCT/US2018/031122

§ 371 (c)(1),
(2) Date: Nov. 5, 2019

(87) PCT Pub. No.: WO2018/204808

PCT Pub. Date: Nov. 8, 2018

(65) Prior Publication Data

US 2020/0088451 A1 Mar. 19, 2020

Related U.S. Application Data

(60) Provisional application No. 62/502,222, filed on May 5, 2017.

(51) Int. Cl.

| | |
|---|---|
| ***F25B 39/02*** | (2006.01) |
| ***F28D 1/00*** | (2006.01) |
| ***F28F 9/02*** | (2006.01) |

(52) U.S. Cl.

CPC ..... *F25B 39/028* (2013.01); *F28D 1/00* (2013.01); *F28F 9/028* (2013.01); *F28F 9/0268* (2013.01); *F28F 9/0273* (2013.01)

(58) Field of Classification Search

CPC ..... F25B 39/028; F28D 1/00; F28F 9/0268; F28F 9/0273; F28F 9/028

(Continued)

(56) References Cited

U.S. PATENT DOCUMENTS 4,524,823 A * 6/1985 Hummel ..... F28F 9/028 165/174
5,067,562 A * 11/1991 Ishii ..... F28D 7/08 165/146

(Continued)

FOREIGN PATENT DOCUMENTS

CN 101520282 A 9/2009
CN 102313400 A 1/2012

(Continued)

OTHER PUBLICATIONS

Merkt, Andreas; International Search Report; PCT/US2018/031122; ISA/EPO; 5 pages; dated Aug. 27, 2018.

(Continued)

*Primary Examiner* — Claire E Rojohn, III
(74) *Attorney, Agent, or Firm* — Cantor Colburn LLP

(57) ABSTRACT

A heat exchanger includes a first header and a second header. The second header has at least a first volume and a second volume. The second header additionally includes a bend region such that the second header has a non-linear configuration. A flow restricting element is arranged within the second header within the bend region. A plurality of heat exchange tubes is arranged in spaced parallel relationship and fluidly coupling the first header and second header.

14 Claims, 8 Drawing Sheets

(58) Field of Classification Search
USPC ..... 62/525
See application file for complete search history.

(56) References Cited

U.S. PATENT DOCUMENTS

| | | | | |
|---|---|---|---|---|
| 7,143,605 | B2 * | 12/2006 | Rohrer | F25B 5/02 62/515 |
| 8,596,081 | B2 * | 12/2013 | Bram | F25B 39/028 62/527 |
| 9,291,407 | B2 * | 3/2016 | Huazhao | F28D 1/05391 |
| 9,423,190 | B2 * | 8/2016 | Huazhao | F28F 9/0273 |
| 9,475,026 | B2 * | 10/2016 | Fitzgerald | C01B 3/384 |
| 9,528,778 | B2 | 12/2016 | Liu | |
| 2010/0089559 | A1 * | 4/2010 | Gorbounov | F25B 39/028 165/174 |
| 2010/0206535 | A1 | 8/2010 | Munoz et al. | |
| 2011/0000255 | A1 | 1/2011 | Taras et al. | |
| 2011/0017438 | A1 | 1/2011 | Huazhao et al. | |
| 2011/0203308 | A1 | 8/2011 | Chiang et al. | |
| 2015/0219375 | A1 | 8/2015 | Yu | |
| 2015/0345843 | A1 | 12/2015 | Voorhis et al. | |
| 2016/0054077 | A1 | 2/2016 | Saito et al. | |
| 2017/0102007 | A1 | 4/2017 | Stauter et al. | |
| 2017/0153062 | A1 * | 6/2017 | Joardar | F28D 7/0066 |
| 2021/0190331 | A1 * | 6/2021 | Onaka | F24F 1/32 |
| 2022/0316804 | A1 * | 10/2022 | Onaka | F28F 9/0204 |

FOREIGN PATENT DOCUMENTS

| | | | |
|---|---|---|---|
| CN | 204285905 | U | 4/2015 |
| EP | 2392886 | A2 | 12/2011 |
| EP | 3236189 | A1 | 10/2017 |
| WO | 2016028878 | A1 | 2/2016 |
| WO | 2017064531 | A1 | 4/2017 |

OTHER PUBLICATIONS

European Office Action; European Application No. 18727502.9; dated May 10, 2022; 5 pages.

* cited by examiner

HEAT EXCHANGER FOR HEAT PUMP APPLICATIONS

CROSS-REFERENCE TO RELATED APPLICATIONS

This application is a 371 U.S. National Stage application of PCT/US2018/031122, filed May 4, 2018, which claims the benefit of U.S. Provisional Application No. 62/502,222, filed May 5, 2017, both of which are incorporated by reference in their entirety herein.

BACKGROUND

Embodiments of this disclosure relate generally to heat exchangers and, more particularly, to a heat exchanger configured for use in air conditioning and heat pump applications.

One type of refrigerant system is a heat pump. A heat pump can be utilized to heat air being delivered into an environment to be conditioned, or to cool and typically dehumidify the air delivered into the indoor environment. In a basic heat pump, a compressor compresses a refrigerant and delivers it downstream through a refrigerant flow reversing device, typically a four-way reversing valve. The refrigerant flow reversing device initially routes the refrigerant to an outdoor heat exchanger, if the heat pump is operating in a cooling mode, or to an indoor heat exchanger, if the heat pump is operating in a heating mode. From the outdoor heat exchanger, the refrigerant passes through an expansion device, and then to the indoor heat exchanger, in the cooling mode of operation. In the heating mode of operation, the refrigerant passes from the indoor heat exchanger to the expansion device and then to the outdoor heat exchanger. In either case, the refrigerant is routed through the refrigerant flow reversing device back into the compressor. The heat pump may utilize a single bi-directional expansion device or two separate expansion devices.

In recent years, much interest and design effort has been focused on the efficient operation of the heat exchangers (indoor and outdoor) in heat pumps. High effectiveness of the refrigerant system heat exchangers directly translates into the augmented system efficiency and reduced life-time cost. One relatively recent advancement in heat exchanger technology is the development and application of parallel flow, microchannel or minichannel heat exchangers, as the indoor and outdoor heat exchangers.

SUMMARY

According to a first embodiment, a heat exchanger includes a first header and a second header. The second header has at least a first volume and a second volume. The second header additionally includes a bend region such that the second header has a non-linear configuration. A flow restricting element is arranged within the second header within the bend region. A plurality of heat exchange tubes is arranged in spaced parallel relationship and fluidly coupling the first header and second header.

In addition to one or more of the features described above, or as an alternative, in further embodiments the flow restricting element is a distributor having a longitudinally elongated body and a plurality of openings formed in the body.

In addition to one or more of the features described above, or as an alternative, in further embodiments at least one of the plurality of openings is arranged at an angle relative to an adjacent end of the plurality of heat exchange tubes.

In addition to one or more of the features described above, or as an alternative, in further embodiments the angle of the at least one opening of the plurality of openings relative to the plurality of heat exchange tubes is between about 60 degrees and about 120 degrees.

In addition to one or more of the features described above, or as an alternative, in further embodiments the at least one of the plurality of openings is oriented such that a heat exchange fluid passes through the at least one opening in a direction substantially opposite a direction of an air flow across the plurality of heat exchange tubes.

In addition to one or more of the features described above, or as an alternative, in further embodiments the plurality of openings is axially spaced such that the plurality of openings is offset from the plurality of heat exchange tubes.

In addition to one or more of the features described above, or as an alternative, in further embodiments comprising an inlet for directing a heat exchange fluid into the distributor, the inlet having a generally angular contour that creates a pressure drop in the heat exchange fluid as it passes through the inlet.

In addition to one or more of the features described above, or as an alternative, in further embodiments the inlet has a bell-curve shape.

In addition to one or more of the features described above, or as an alternative, in further embodiments the flow restricting element, additionally includes a dividing plate coupled to the distributor.

In addition to one or more of the features described above, or as an alternative, in further embodiments the bend region is formed at an interface between the first volume and the second volume, and a first portion of the flow restricting element is arranged within the first volume, and a second portion of the flow restricting element is arranged within the second volume.

In addition to one or more of the features described above, or as an alternative, in further embodiments comprising another flow restricting device arranged within the first header.

In addition to one or more of the features described above, or as an alternative, in further embodiments the first header includes at least a first volume and a second volume, and the another flow restricting element is arranged within the first volume of the first header.

In addition to one or more of the features described above, or as an alternative, in further embodiments the first volume of the first header receives a liquid heat exchange fluid.

In addition to one or more of the features described above, or as an alternative, in further embodiments the heat exchanger is a component of a heat pump.

In addition to one or more of the features described above, or as an alternative, in further embodiments the heat exchanger has a multi-pass configuration such that a first portion of the plurality of heat exchange tubes is coupled to the first volume and form a first fluid pass of the heat exchanger and a second portion of the plurality of heat exchange tubes is coupled to the second volume and form a second fluid pass of the heat exchanger.

According to another embodiment, a heat exchanger includes a first header and a second header having at least a first volume and a second volume. A plurality of heat exchange tubes is arranged in spaced parallel relationship and fluidly coupling the first header and second header. A flow restricting element is arranged within the first header to define an inlet volume and an outlet volume thereof. The outlet volume is in fluid communication with a portion of the plurality of heat exchange tubes. The flow restricting element comprising a thickness and a plurality of flow holes formed in the thickness to fluidly couple the inlet volume and the outlet volume. The plurality of flow holes is arranged at an angle relative to the portion of the plurality of heat exchange tubes.

In addition to one or more of the features described above, or as an alternative, in further embodiments the angle of the plurality of flow holes is between about 20 degrees and about 70 degrees.

In addition to one or more of the features described above, or as an alternative, in further embodiments the plurality of flow holes are axially spaced at intervals along a longitudinal axis of the flow restricting element.

In addition to one or more of the features described above, or as an alternative, in further embodiments the plurality of flow holes are arranged in pairs comprising a first flow hole and a second flow hole arranged on opposing sides of a central axis of the flow restricting element.

In addition to one or more of the features described above, or as an alternative, in further embodiments the first flow hole is arranged at a first angle and the second flow hole is arranged at a second angle, the first angle and the second angle being different.

According to yet another embodiment, a method of manufacturing a heat exchanger includes forming a heat exchanger coil including a first header, a second header, and a plurality of heat exchange tubes arranged in spaced parallel relationship and fluidly coupling the first header and second header. A flow restricting device is affixed at a desired position within at least one of the first header and the second header. The heat exchanger coil, including the flow restricting device, is bent into a desired shape. The desired shape has at least one linear section and at least one bent section. The flow restricting device is arranged at least partially in the bent section.

In addition to one or more of the features described above, or as an alternative, in further embodiments the flow restricting device includes a longitudinally elongated distributor, and affixing the flow restricting device at a desired position within at least one of the first header and the second header further comprises arranging a flexible material within the header to restrict movement of the distributor during bending.

In addition to one or more of the features described above, or as au alternative, in further embodiments comprising removing the flexible material from the header after bending the heat exchanger coil into the desired shape.

In addition to one or more of the natures described above, or as an alternative, in further embodiments the flow restricting device includes a longitudinally elongated distributor connected to a dividing plate, and affixing the flow restricting device at a desired position within at least one of the first header and the second header further comprises mounting a periphery of the dividing plate to an interior surface of the at least one of the first header and second header.

In addition to one or more of the features described above, or as an alternative, in further embodiments the flow restricting device is positioned within the at least one linear section.

In addition to one or more of the features described above, or as an alternative, in further embodiments the flow restricting device is positioned within the at least one bent section.

BRIEF DESCRIPTION OF THE DRAWINGS

The subject matter, which is regarded as the present disclosure, is particularly pointed out and distinctly claimed in the claims at the conclusion of the specification, The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Microchannel heat exchangers have a small internal volume and therefore store less refrigerant charge than conventional round tube plate fin heat exchangers. Although a lower refrigerant charge is generally beneficial, the smaller internal volume of microchannel heat exchangers makes them extremely sensitive to overcharge or undercharge situations, which could result in refrigerant charge imbalance, degrade refrigerant system performance, and cause nuisance shutdowns. In addition, the refrigerant charge contained in the manifolds of the microchannel heat exchanger, particularly when the heat exchanger operates as a condenser, is significant, such as about half of the total heat exchanger charge. As a result, the refrigerant charge reduction potential of the heat exchanger is limited.

Figure 1:
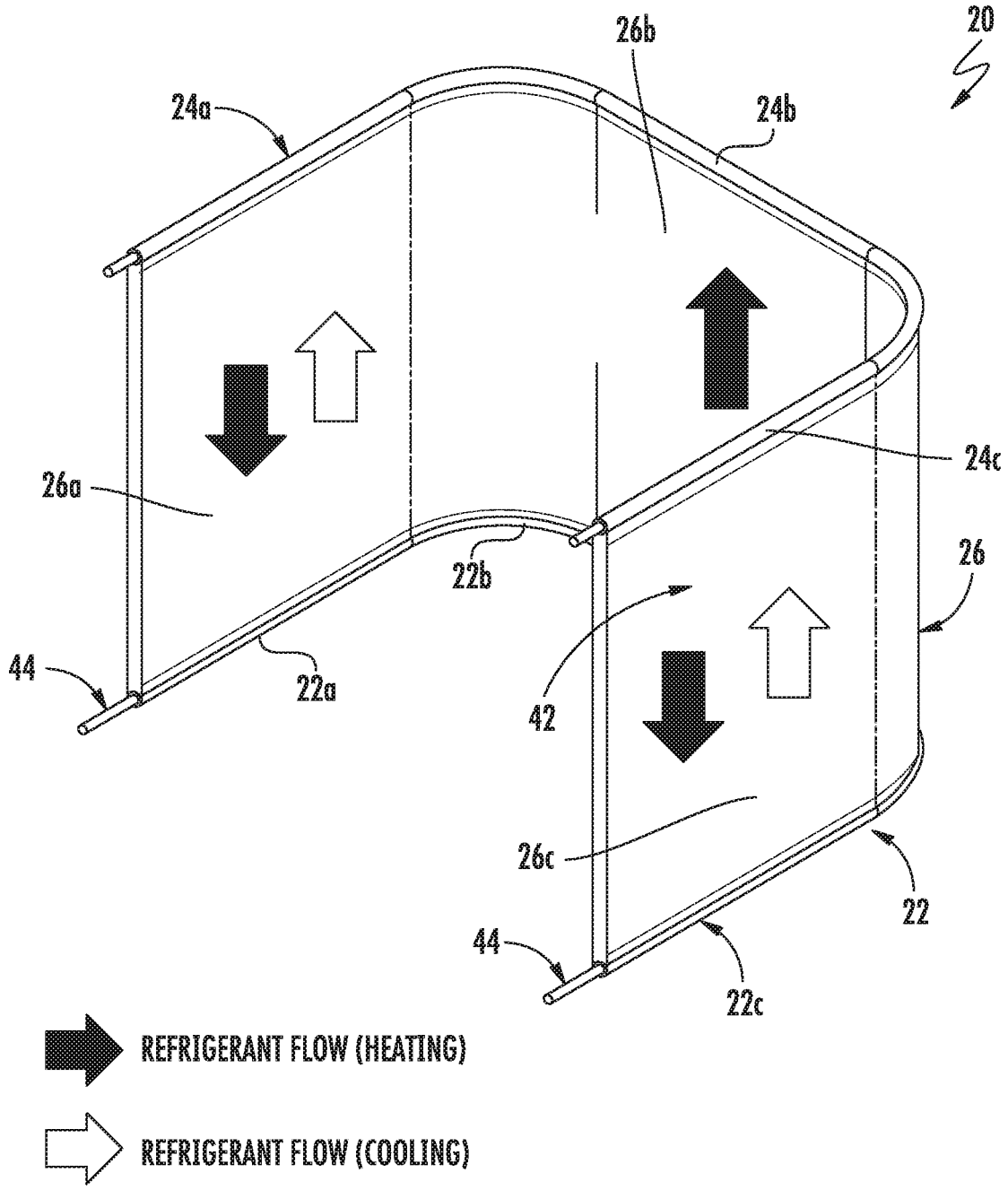
FIG. 1 perspective view of a heat exchanger of a heat pump according to an embodiment.

Referring now to FIG. 1, an example of a heat exchanger configured for use in heat pump applications is illustrated. The heat exchanger 20 includes a first manifold 22 (also referred to herein as first header 22), a second manifold 24 (also referred to herein as second header 24) spaced apart from the first manifold 22, and a plurality of heat exchange tubes 26 extending in a spaced parallel relationship between and fluidly connecting the first header 22 and the second header 24. In the illustrated, non-limiting embodiment, the first header 22 and the second header 24 are oriented generally horizontally and the heat exchange tubes 26 extend generally vertically between the two headers 22, 24. By arranging the tubes 26 vertically, water condensate collected on the tubes 26 is more easily drained from the heat exchanger 20. However, in other embodiments, a heat exchanger 20 having another configuration, such as where the headers 22, 24 are arranged vertically and the plurality of heat exchanger tubes 26 extend horizontally for example, are also within the scope of the disclosure.

In the non-limiting embodiments illustrated in the FIGS., the headers 22, 24 are bent to form a heat exchanger 20 having a desired shape (e.g., a "C", "U", "V", "W" or "J" shape). Each of headers 22, 24 is shown comprising a hollow, closed end cylinder having a generally circular cross-section. However, headers 22, 24 having other configurations, such as elliptical, semi-elliptical, square, rectangular, hexagonal, octagonal, or other cross-sections for example, are within the scope, of the disclosure. The heat exchanger 20 may be used as either a condenser or an evaporator in a vapor compression system, such as a heat pump system or air conditioning system for example.

Figure 2:
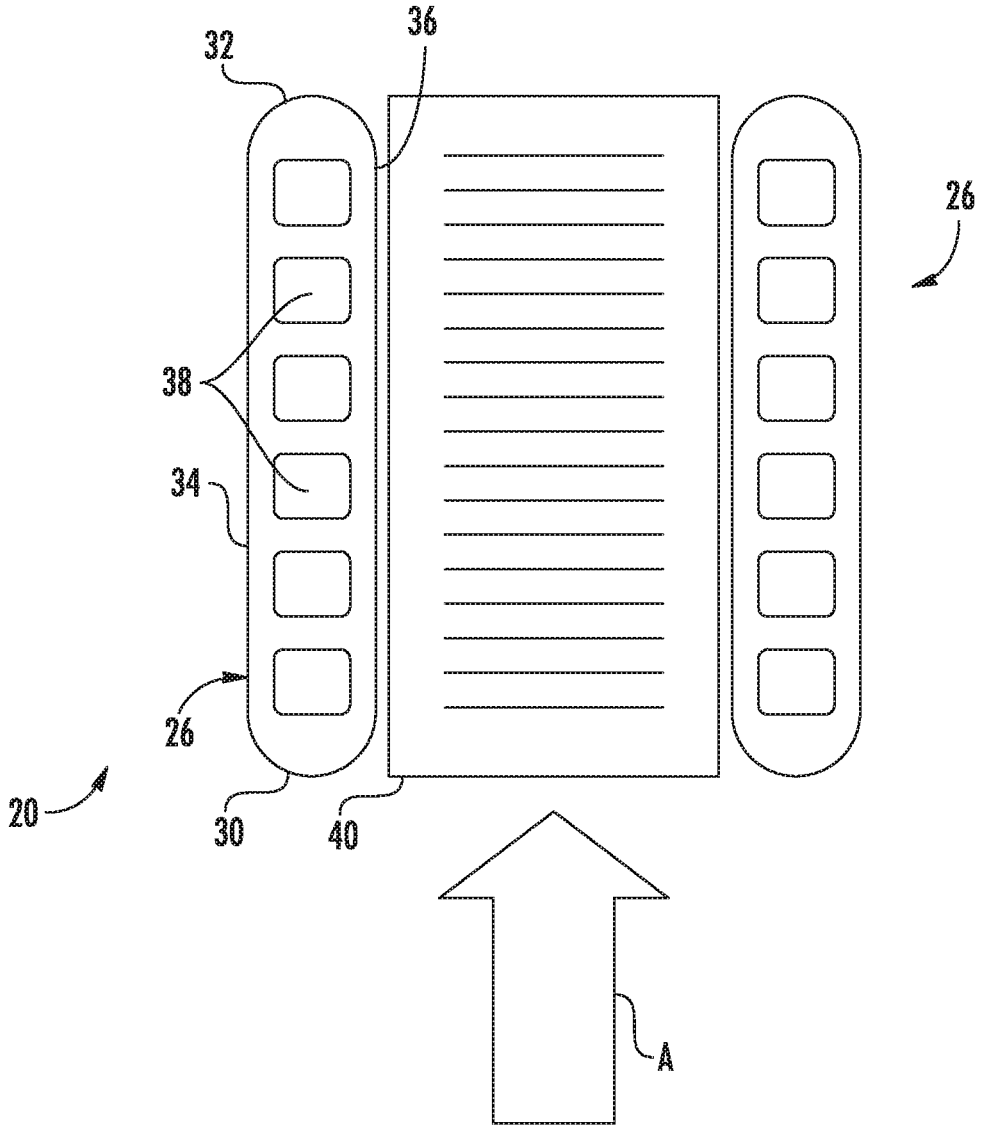
FIG. 2 is a cross-sectional view of a portion of the heat exchanger of FIG. 1 according to an embodiment

The heat exchanger 20 can be any type of heat exchanger, such as a round rube plate, fin (RTPF) type heat exchanger or a microchannel heat exchanger for example. Referring now to FIG. 2, in embodiments where the heat exchanger 20 is a microchannel heat exchanger, each heat exchange tube 26 comprises a flattened heat exchange tube having a leading edge 30, a trailing edge 32, a first surface 34, and a second surface 36. The leading edge 30 of each heat exchanger tube 26 is upstream of its respective trailing edge 32 with respect to an airflow A through the heat exchanger 20. The interior flow passage of each heat exchange tube 26 may be divided by interior walls into a plurality of discrete flow channels 38 that extend over the length of the tubes 26 from an inlet end to an outlet end and establish fluid communication between the respective first and second manifolds 22, 24. The flow channels 38 may have a circular cross-section, a rectangular cross-section, a trapezoidal cross-section, a triangular cross-section, or another non-circular cross-section. The heat exchange tubes 26 including the discrete flow channels 48 may be formed using known techniques and materials, including, but not limited to, extrusion or folding.

A plurality of heat transfer fins 40 (FIG. 2) may be disposed between and rigidly attached, e.g., by a furnace braze process, to the heat exchange tubes 26, in order to enhance external heat transfer and provide structural rigidity to the hear exchanger 22. The fins 40 may be configured with any of a plurality of configurations. In one embodiment, each fin 40 is formed from a plurality of connected strips or a single continuous strip of fin material tightly folded in a ribbon-like serpentine fashion. Heat exchange between the fluid within the heat exchanger tubes 26 and the air flow A, occurs through the outside surfaces 34, 36 of the heat exchange tubes 26 collectively forming the primary heat exchange surface, and also through the heat exchange surface of the fins 40, which form the secondary heat exchange surface.

The heat exchanger 20 may be configured with a single or multi-pass flow configuration. To form a multi-pass flow configuration, at least one of the first manifold 22 and the second manifold 24 includes two or more fluidly distinct sections or chambers. In one embodiment the fluidly distinct sections are formed by coupling separate manifolds together to form the first or second manifold 22, 24. Alternatively, a baffle or divider plate (not shown) known to a person of ordinary skill in the art may be arranged within at least one of the first header 22 and the second header 24 to define a plurality of fluidly distinct sections therein.

In the illustrated, non-limiting embodiment of FIG. 1, the heat exchanger 20 is configured with a two-pass flow arrangement. As a result, at least one of the first header 22 and the second header 24, and therefore the heat exchange tubes 26 fluidly connected to a portion of an interior volume of the headers 22, 24 can be divided into plurality of sections, such as a first, second, and third section, respectively. In FIG. 1, the boundaries between adjacent groups of heat exchange tubes 26 are illustrated schematically with a dotted line. For example, the heat exchanger of FIG. 1 includes a first group 26*a* of heat exchanger tubes 26 extending vertically between and fluidly coupled to an inner volume of the first sections 22*a*, 24*a* of the first and second header 22, 24. A second group 26*b* of heat exchanger tubes 26 extends vertically between and fluidly couples an inner volume of the second sections 22*b*, 24*b* of the first and second header 22, 24. A third group 26*c* of heat exchanger tubes 26 extends vertically between and fluidly couples an inner volume of the third sections 22*c*, 24*c* of the first and second header 22, 24.

Although embodiments where the heat exchange tubes 26 are divided into three groups are illustrated, a heat exchanger 20 having any number of passes and therefore any number groups of heat exchange tubes 24 is within the scope of the disclosure. A length of the plurality of sections of the headers 22, 24 and the number of tubes 26 within the distinct groups 26*a*, 26*b*, 26*c* may, but need not be substantially identical. In one embodiment, the sections of the headers 22, 24 are formed arranging a baffle plate or other divider 50 (see FIG. 3) at a desired location within the headers 22, 24.

The direction of fluid flow through the heat exchanger 22, as illustrated by the arrows, depends on the mode in which the heat pump 20 is being operated. For example, when the heat exchanger 20 illustrated in FIG. 1 is configured to operate as an evaporator and heat the fluid therein, a two-phase heat transfer fluid moves through the heat exchanger 20 in a direction indicated by a first set of arrows in the FIG. As shown, the two-phase heat transfer fluid is provided via an inlet 42 (shown with dashed line representing the inlet location behind the third group 26*c* of tubes 26 from the perspective of the figure) to the second section 22*b* of the first header 22. Within the second section 22*b*, the heat transfer fluid is configured to flow through the second group 26*b* of tubes 26 to the second section 24*b* of the second header 24. From the second section 24*b* of the second header 24, the fluid flow divided such that a portion of the fluid flows into the first section 24*a* of the second header 24 and a portion of the fluid flows into the third section 24*c* of the second header 24, and through the first and third groups of tubes of tubes 26*a*, 26*c*, respectively. Once received within the first section 22*a* of the first header 22 and the third section 22 of the first header 22, the fluid is provided via outlets 44 to a conduit (not shown) where the fluid is rejoined and provided to a downstream component of a vapor compression system.

As the heat transfer fluid flows sequentially through second and first groups 26*b*, 26*a* of heat exchanger tubes 26, or alternatively, through the second and third groups 26*b*, 26*c* of heat exchanger tubes 26, heat from an adjacent flow of air A, is transferred to the heat transfer fluid. As a result, a substantially vaporized heat transfer fluid is provided at the outlets 44. Alternatively, heat transfer fluid is configured to flow in a reverse direction through the heat exchanger 20, indicated by a second set of arrows, when operated as a condenser. The configuration of the heat exchanger 20 illustrated and described herein is intended as an example only, and other types of heat exchangers 20 having any number of passes are within the scope of the disclosure.

Figure 3:
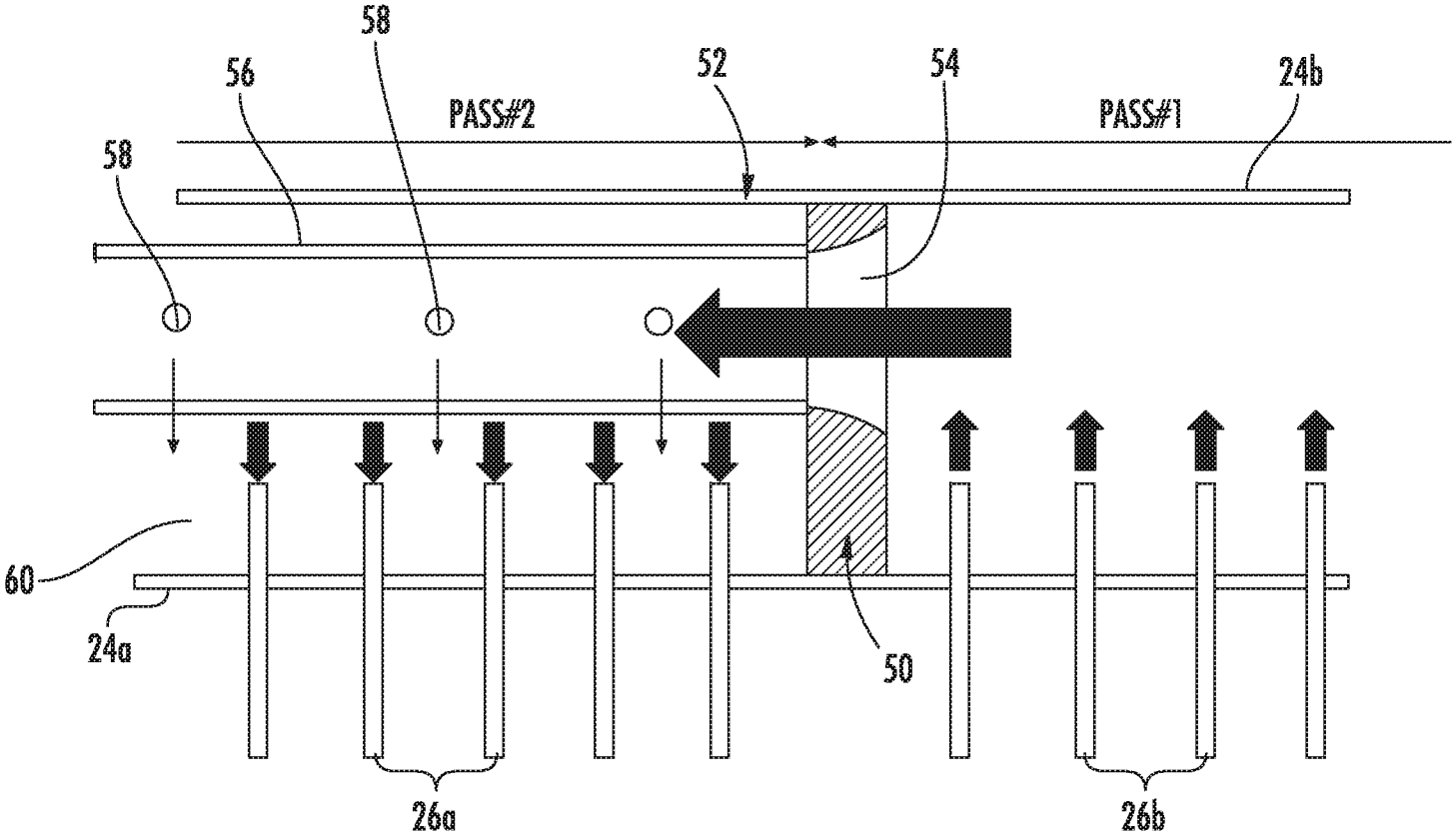
FIG. 3 is a cross-sectional view of an intermediate header of the heat exchanger of FIG. 1 according to an embodiment.
Figure 4:
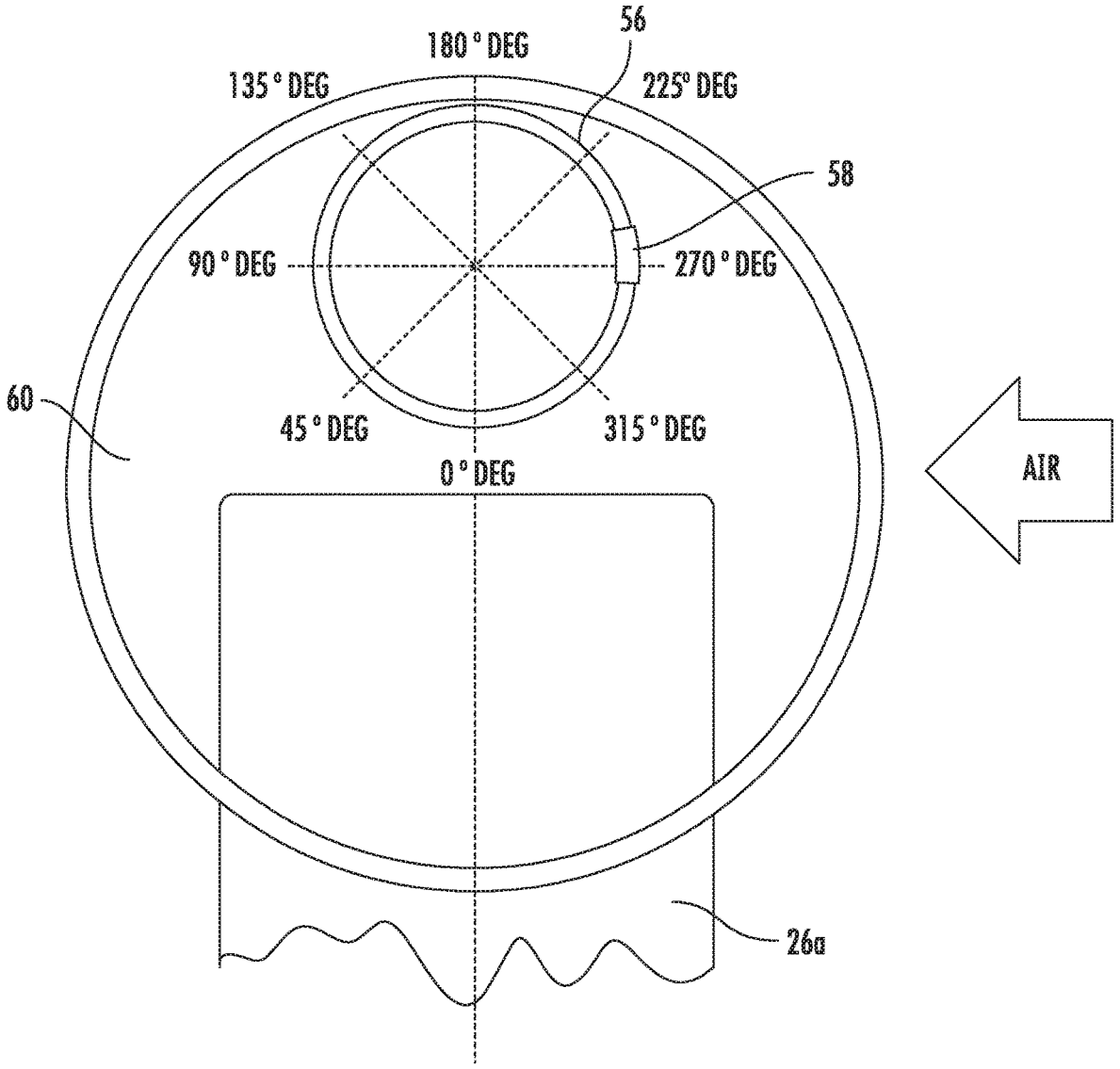
FIG. 4 is a cross-sectional view of the header of FIG. 3 taken in the plane of the air flow according to an embodiment.

Referring now to FIGS. 3 and 4, fluid flow within an intermediate header between a first volume associated with the first pass of the heat exchanger 20 and a second volume associated with the second pass of the heat exchanger 20, for example between the second section 24*h* and the first section 24*a* of the second header 24, or between the second section 24*b* and the third section 24*c* of the second header 24 is controlled via a flow restricting element 52. In an embodiment, the flow restricting element 52 includes a dividing plate 50 having an opening or orifice 54 formed therein and a longitudinally elongated distributor 56 fluidly coupled thereto. The opening or orifice 54 can have any shape, including but not limited to, a bell mouth, straight converging, straight bore or my suitable alternative for example. As shown, the distributor 56 may be arranged generally centrally within the inner volume of the first section 24*a* of the second header 24 and includes a plurality to openings 58 for distributing the flow of heat transfer fluid into the first section 24*a* of the header 24 and the corresponding heat exchanger tubes 26*a* fluidly coupled thereto. The inner volume 60 of the first section 24*a* of the second header 24 must therefore be large enough to contain the tube ends 26*a* and a distributor 56 in a spaced apart relation such that an unobstructed fluid flow path exists from an inner volume 60 of the distributor 56 to an inner volume 60 of the header 24*a* and into the ends of the heat exchanger tubes 26*a*. Although illustrated and described with respect to the first section 24*a* of the second header 24, it should be understood that the alternative embodiments including a flow restricting element 52 extending into the third section 24*c* of the second header 24 are also contemplated herein.

The distributor 56 may be any type of distributor. In addition, although the distributor illustrated in FIGS. 3 and 4 are shown as having a generally circular cross-section, a distributor 56 having any cross-sectional shape is contemplated herein. In an embodiment, an inlet for directing the heart exchanger fluid into the distributor 56 has a generally angled contour, such as a bell mouth shape for example, to create a pressure drop in the fluid as it flows into the distributor 56. The contour may be formed in the end of the distributor 56 coupled to the dividing plate 50, or alternatively, may be formed in the orifice 54 of the dividing plate 50, as shown in FIG. 3.

The plurality of openings 58 formed in the distributor 56 are generally arranged at an angle to each of the plurality of heat exchanger tubes 26 such that one or more of the openings do not directly face a corresponding tube 26. As a result, refrigerant expelled from the distributor 56 is not directly injected into the plurality of tubes 26. For example, the plurality of openings 58 may be arranged at an angle between about 60 degrees and about 120 degrees from the ends of the heat exchange tubes 26, and more specifically between 70 degrees and 110 degrees, and between 80 degrees and 100 degrees, such as 90 degrees for example. In an embodiment, the plurality of openings 58 are oriented generally perpendicular to the heat exchanger tubes 26, such that the heat exchanger fluid passes through the openings 58 in a direction substantially opposite the direction of air flow for example. However, embodiments where the openings 58 are arranged at any angle relative to the heat exchange tubes 26 are within the scope of the disclosure. Further, the plurality of openings 58 formed in the distributor 56 may be axially offset from an adjacent heat exchanger tube 26. In an embodiment, the openings 58 are positioned between adjacent heat exchange tubes 26, such as centered between adjacent heat exchange tubes 26 for example.

The configuration of each opening 58, including, the size and cross-sectional shape thereof, may be selected to control a flow of refrigerant. In the illustrated non-limiting embodiment, each of the plurality of openings 58 is substantially identical. However, in alternative embodiments, one or more of the plurality of openings 58 may vary in size, shape, and/or position relative to the distributor 56. The plurality of openings 58 may be configured such that the mass flux through the openings 58 is at least 100 $lb/ft^2s$ and in some embodiments, is between about 100 $lb/ft^2s$ and about 300 $lb/ft^2s$. The mass flux is generally determined by the total number of openings 58 formed in the distributor 56 and the overall size of each of the openings 58. Systems having a mass flux within this range are believed to have a desired operation balance between pressure drop in the fluid and system performance.

Figure 5:
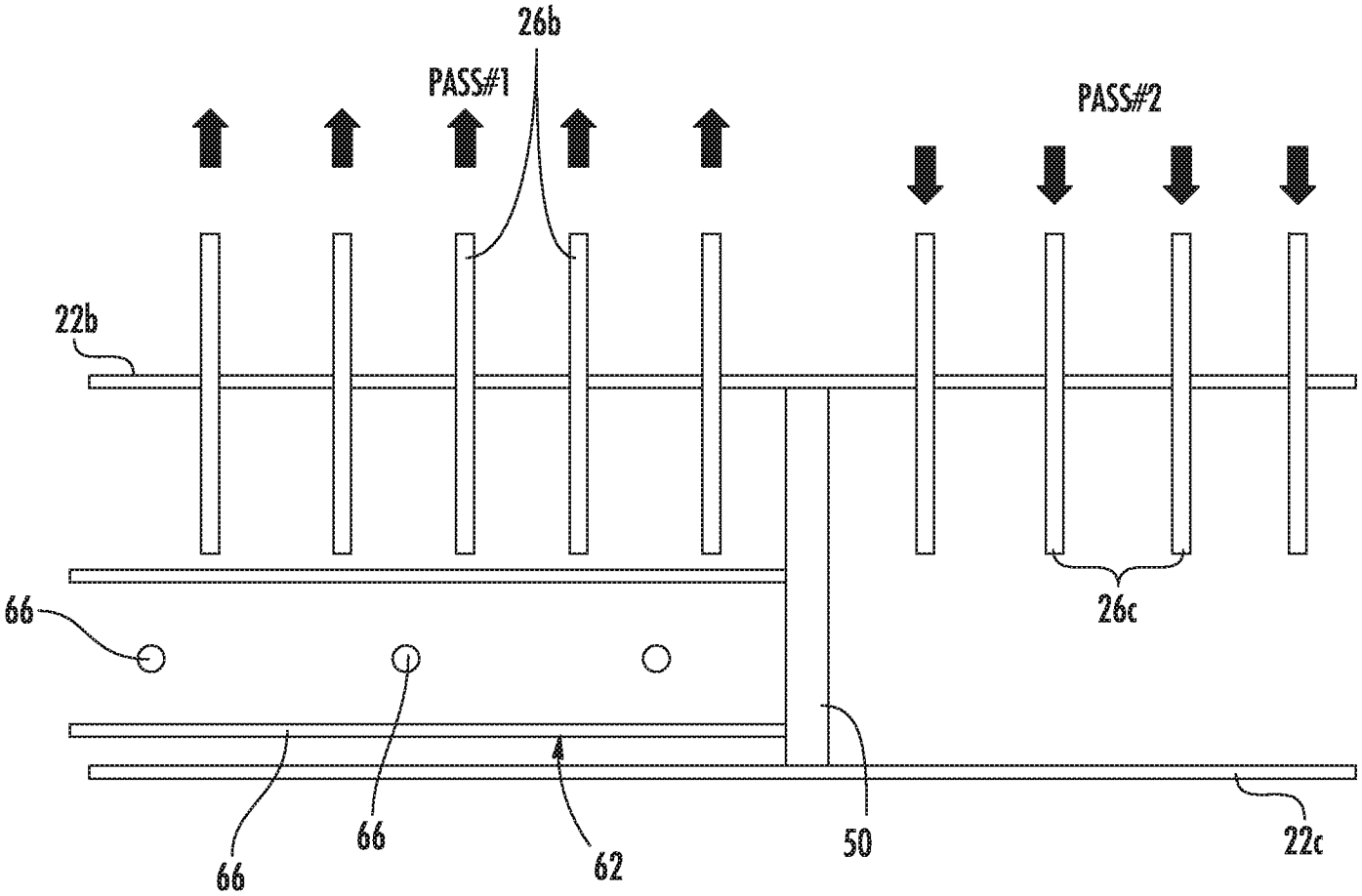
FIG. 5 is a cross-sectional view of a liquid header of the heat exchanger of FIG. 1 according to an embodiment.
Figure 6:
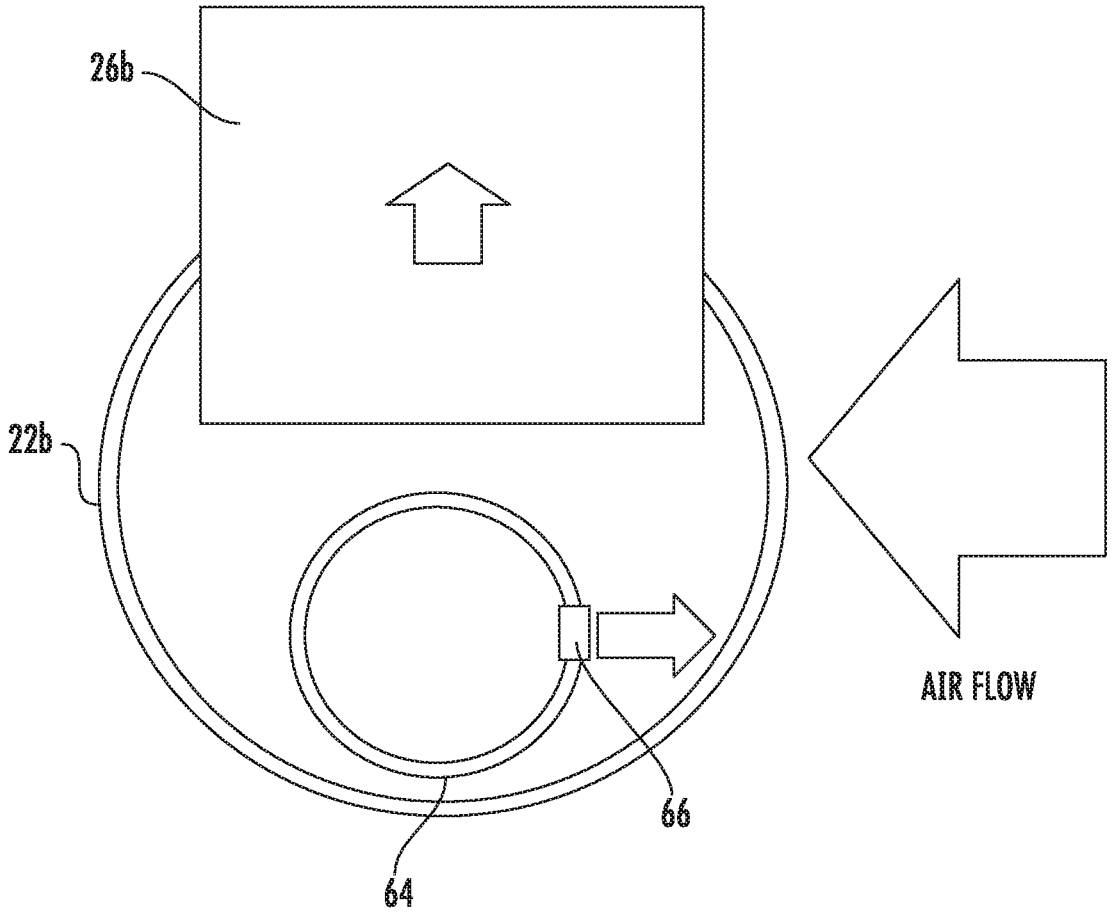
FIG. 6 is a cross-sectional view of the header of FIG. 5 taken in the plane of the air flow according to an embodiment.

With reference now to FIGS. 5-8, a flow restricting device 62, such as another distributor 64 for example, may be positioned within the portion of the heat exchanger 20 configured to receive a substantially liquid flow of heat exchanger fluid. In the illustrated, non-limiting embodiment, the second section 22*b* of the first header 22 is configured to receive a liquid heat exchange fluid regardless of the mode of operation of the heat exchanger 20. Examples of suitable distributors contemplated for use within the liquid header of the heat exchanger 20 are disclosed in U.S. patent application Ser. No. 15/504,994, filed on Feb. 17, 2017, the entire contents of which are incorporated herein by reference. The distributor 64 may be a longitudinally elongated tube connected to a dividing plate 50 as shown in FIGS. 5 and 6. As shown, the distributor 64 may be arranged generally centrally within the inner volume of the second section 22*b* of the first header 22 and includes a plurality to openings 66 for distributing the flow of heat transfer fluid into the corresponding heat exchanger tubes 26*b* fluidly coupled thereto. Similar to distributor 56 positioned within the intermediate header, the plurality of openings 66 formed in the distributor 64 may be arranged at an angle to each of the plurality of heat exchanger tubes 26*b* such that one or mote of the openings 66 do not directly face a corresponding tube 26*b*. As a result, refrigerant expelled from the distributor 64 is not directly injected into the plurality of tubes 26*b*.

Figure 7:
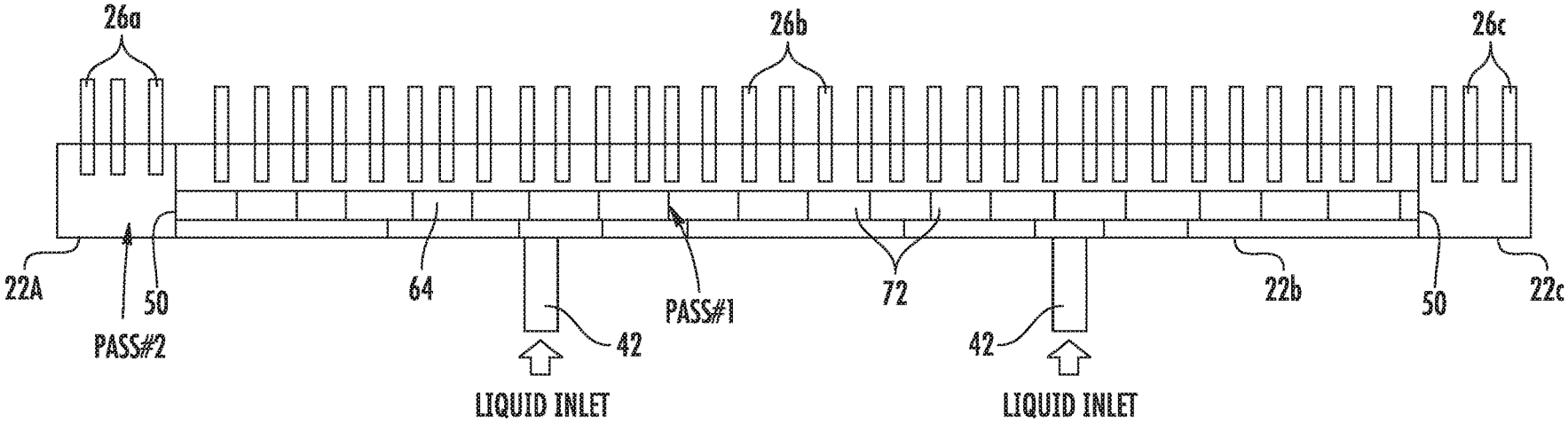
FIG. 7 is a cross-sectional view of a liquid header of the heat exchanger of FIG. 1 according to another embodiment.
Figure 8:
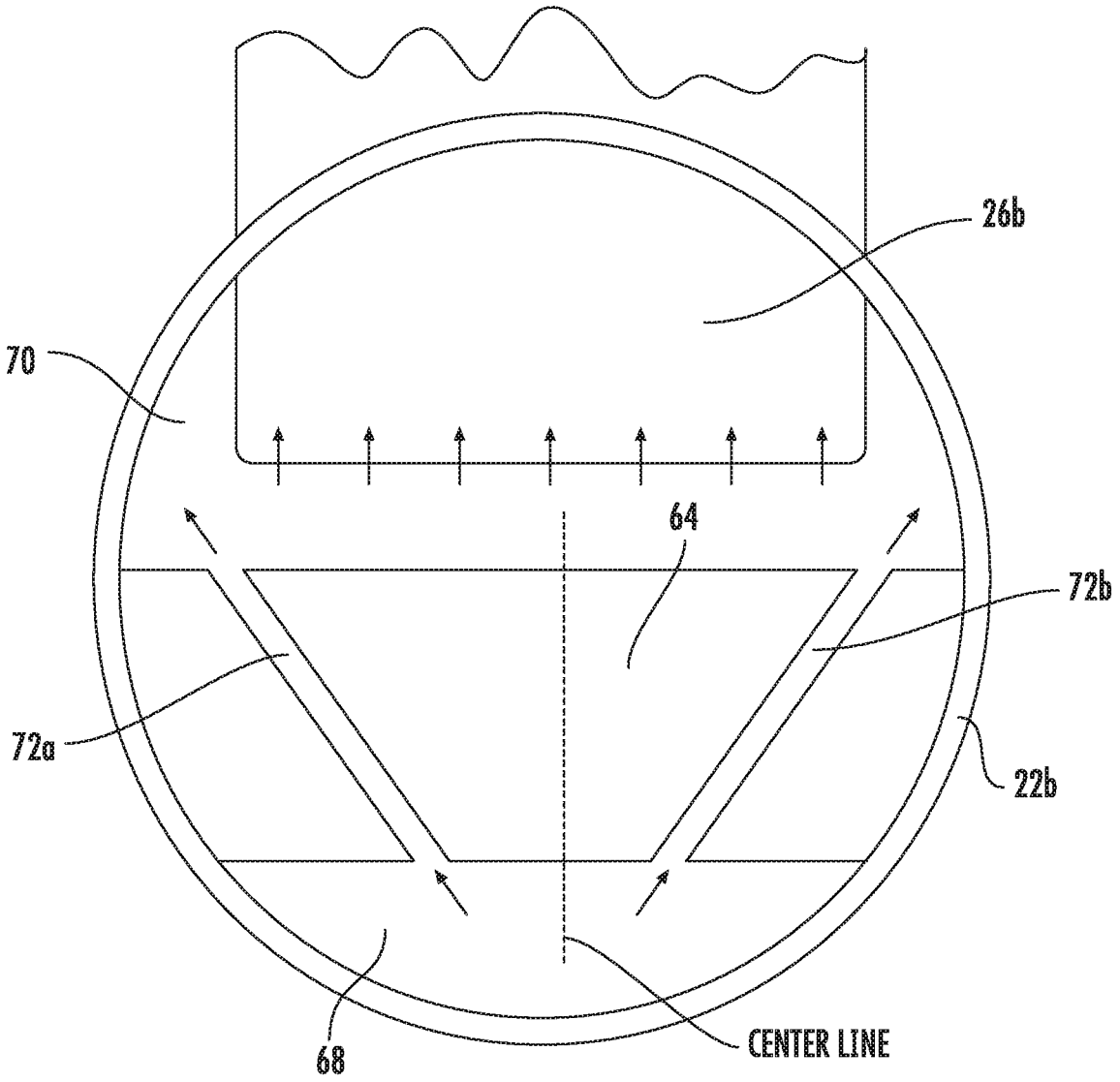
FIG. 8 is a cross-sectional view of the header of FIG. 7 taken in the plane of the air flow according to an embodiment.

In an alternate embodiment, illustrated in FIGS. 7 and 8, the distributor 64 is a plate distributor configured to reduce the inner volume within the header. The plate distributor is arranged generally centrally within the header to define an inlet portion 68 of the header and an outlet portion 68 of the header. The outlet portion 70 of the header is fluidly coupled to the plurality of heat exchanger tubes 26*b*.

The plate distributor 64 may have at least one of a size and shape generally complementary to an interior of the header 22*b*. The plate distributor 64 may be integrally formed with the header 22*b*, or alternatively, may be a separate removable sub-assembly inserted into the inner volume thereof, such as supported by the dividing plate 50 for example. The plate distributor 64 may be formed from a metal or non-metal material, such as a foam, mesh, woven wire or thread, or a sintered metal for example, and can have a uniform or non-uniform porosity.

The distributor 64 includes a plurality of openings 72 formed at axially spaced intervals over the length of the distributor to fluidly couple the inlet and outlet portions 68, 70 of the header 22*b*. In operation, the heat exchanger fluid is provided to the inlet portion 68 of the header 22*b*, and is configured to pass through the plurality of distributor openings 72 to one or more heat exchanger tubes 36. As shown, the openings 72 do not extend vertically in direct alignment with the heat exchanger tubes 26*b*. Rather, the plurality of openings 72 are arranged at an angle between about 20 and about 70 degrees, such as between about 30 and about 60 degrees, or 45 degrees for example, relative to the heat exchange tubes 26.

In an embodiment, the plurality of openings 72 may be arranged in pairs. Each pair includes a first opening 72*a* disposed on a first side of a center line of the distributor and extending at a first angle relative to the heat exchange tubes 26 and a second opening 72*b* disposed on a second opposite side of the center line and extending at a second angle relative to the heat exchange tubes 26. The first angle and the second angle may, but need not be generally equal, in addition, the first and second opening 72*a*, 72*b* of a pair may be arranged within the same cross-sectional plane of the distributor, taken perpendicular to the length of the distributor. Alternatively, the first opening 72*a* and the second opening 72*b* may be staggered in different planes perpendicular to the length of the distributor 64.

The distributors illustrated and described herein may have a generally linear configuration, or alternatively may have a bent configuration complementary to a bend formed in a corresponding header. In an embodiment, to manufacture the heat exchanger, the heat exchanger including the first header 22, second header 24, and heat exchanger tubes 26 is formed as a long flat coil. In this configuration, the one or more distributors are mounted at a desired position within the intermediate header and/or the liquid header. Once the distributor is fixedly mounted to the header, the heat exchanger 20, including the one or more distributors, is then bent to form a desired shape. The distributor and/or a dividing plate for supporting the distributor may be positioned at any location within the headers, including the bent region formed via one or more bending operations.

To mount the one or more distributors, the one or more distributors are inserted into the unbent headers. In an embodiment, the longitudinal axis of the one or more distributors is arranged substantially coaxial with the longitudinal axis defined by a respective header. However, in other embodiments, the distributor and the header may not be arranged coaxially. The distributor may be secured within the header via any suitable method, such as welding, a snap fit, a threaded engagement, or other similar methods including protrusions/indentions or otherwise complementary surfaces to secure the distributor in place during a combination including at least one of fabrication, shipping, installation, and operation of the heat exchanger. In embodiment where the distributor is coupled to a dividing plate, the distributor is installed via attachment of a corresponding dividing plate at a desired position within the header. The dividing plate (e.g. with our without mixing holes there through) may be attached to the header via any of the suitable methods described above. Alternatively, or in addition, one or more inserts, such as formed from a flexible material for example, may be installed into the header adjacent the distributor. The inserts may be arranged to restrict undesired movement of the distributor during the bending operation. After the bending operation is complete, the inserts may then be removed from the header.

The heat exchanger 20 illustrated and described herein has a reduced manufacturing cost compared to conventional heat exchangers. Inclusion of a flow restriction device in at least one of an intermediate header and a liquid header improves the refrigerant distribution within the heat exchanger when operated in an evaporation mode. In addition, the low pressure drop of the distributor within the intermediate header maximizes the performance of the heat exchanger 20.

Embodiment 1: A heat exchanger, comprising: a first header; a second header having at least a first volume and a second volume, wherein the second header includes a bend region such that the second header has a non-linear configuration; a flow restricting element at ranged within the second header within the bend region; and a plurality of heat exchange tubes arranged in spaced parallel relationship and fluidly coupling the first header and second header.

Embodiment 2: The heat exchanger of embodiment 1, wherein the flow restricting element is a distributor having a longitudinally elongated body and a plurality of openings formed in the body.

Embodiment 3: The heat exchanger of embodiment 2, wherein at least one of the plurality of openings is arranged at an angle relative to an adjacent end of the plurality of heat exchange tubes.

Embodiment 4: The heal exchanger of embodiment 3, wherein the angle of the at least one opening of the plurality of openings relative to the plurality of heat exchange tubes is between about 60 degrees and about 120 degrees.

Embodiment 5: The heat exchanger of any of embodiments 2-4, wherein the at least one of the plurality of openings is oriented such that a heat exchange fluid passes through the at least one opening in a direction substantially opposite a direction of an air flow across the plurality of heat exchange tubes.

Embodiment 6: The heat exchanger of any of embodiments 2-5, wherein the plurality of openings is axially spaced such that the plurality of openings is offset from the plurality of heat exchange tubes.

Embodiment 7: The heat exchanger of any of embodiments 2-6, further comprising an inlet for directing a heat exchange fluid into the distributor, the inlet having a generally angular contour that creates a pressure drop in the heat exchange fluid as it passes through the inlet.

Embodiment 8: The heat exchanger of embodiment 7, wherein the inlet has a bell-curve shape.

Embodiment 9: The heat exchanger of any of embodiments 2-8, wherein the flow restricting element additionally includes a dividing plate coupled to the distributor.

Embodiment 10: The heat exchanger of embodiment 9, wherein the bend region is formed at an interface between the first volume and the second volume, and a first portion of the flow restricting element is arranged within the first volume, and a second portion of the flow restricting element is arranged within the second volume.

Embodiment 11: The heat exchanger of embodiment 1, further comprises another flow restricting device arranged within the first header.

Embodiment 12: The heat exchanger of embodiment 11, wherein the first header includes at least a first volume and a second volume, and the another flow restricting element is arranged within the first volume of the first header.

Embodiment 13: The heat exchanger of embodiment 12, wherein the first volume of the first header receives a liquid heat exchange fluid.

Embodiment 14: The heat exchanger of any of the preceding embodiments, wherein the heat exchanger is a component of a heat pump.

Embodiment 15: The heat exchanger of embodiment 1, wherein the heat exchanger has a multi-pass configuration such that a first portion of the plurality of heat exchange tubes is coupled to the first volume, and form a first fluid pass of the heat exchanger and a second portion of the plurality of heat exchange tubes is coupled to the second volume and form a second fluid pass of the heat exchanger.

Embodiment 16: A heat exchanger, comprising: a first header, a second header having at least a first volume and a second volume; a plurality of heat exchange tubes arranged in spaced parallel relationship and fluidly coupling the first header and second header; a flow restricting element arranged within the first header to define au inlet volume and an outlet volume thereof, the outlet volume being arranged in fluid communication with a portion of the plurality of heat exchange tubes, the flow restricting element comprising a thickness and a plurality of flow holes formed in the thickness to fluidly couple the inlet volume and the outlet volume, the plurality of flow holes being arranged at an angle relative to the portion of the plurality of heat exchange tubes.

Embodiment 17: The heat exchanger of embodiment 16, wherein the angle of the plurality of flow holes is between about 20 degrees and about 70 degrees.

Embodiment 18: The heat exchanger of embodiment 16, wherein the plurality of flow holes are axially spaced at intervals along a longitudinal axis of the flow restricting element.

Embodiment 19: The heat exchanger of any of embodiments 16-18, wherein the plurality of flow holes are arranged in pairs comprising a first flow hole and a second flow hole arranged on opposing sides of a central axis of the flow restricting element.

Embodiment 20: The heat exchanger of embodiment 19, wherein the first flow hole is arranged at a first angle and the second flow hole is arranged at a second angle, the first angle and the second angle being different.

Embodiment 21: A method of manufacturing a heat exchanger, comprising: forming a heat exchanger coil including a first header, a second header, and a plurality of heat exchange tubes arranged in spaced parallel relationship and fluidly coupling the first header and second header; affixing a flow restricting device at a desired position within at least one of the first header and the second header; and bending the heat exchanger coil, including the flow restricting device, into a desired shape, the desired shape having at least one linear section and at least one bent section, wherein the flow restricting device is arranged at least partially in the bent section.

Embodiment 22: The method of embodiment 21, wherein the flow restricting device includes a longitudinally elongated distributor, and affixing the flow restricting device at a desired position within at least one of the first header and the second header further comprises arranging a flexible material within the header to restrict movement of the distributor during bending.

Embodiment 23: The method of embodiment 21 or 22, further comprising removing the flexible material from the header after bending the heat exchanger coil into the desired shape.

Embodiment 24: The method of embodiments 21-23, wherein the flow restricting device includes a longitudinally elongated distributor connected to a dividing plate, and affixing the flow restricting device at a desired position within at least one of the first header and the second header further comprises mounting a periphery of the dividing plate to an interior surface of the at least one of the first header and second header.

Embodiment 25: The method of embodiments 21-24, wherein the flow restricting device is positioned within the at least one linear section.

Embodiment 26: The method of embodiments 21-25, wherein the flow restricting device is positioned within the at least one bent section.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure.

Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A heat exchanger, comprising:

a first header;

a second header having at least a first volume and a second volume, wherein the second header includes a bend region such that the second header has a non-linear configuration;

a flow restricting element arranged within the second header within the bend region, the flow restricting element including a distributor having a longitudinally elongated body and a plurality of openings formed in the body, wherein the body has a bend formed therein, the bend being complementary to the bend region of the second header; and a plurality of heat exchange tubes arranged in spaced parallel relationship and fluidly coupling the first header and second header.

2. The heat exchanger of claim 1, wherein at least one of the plurality of openings is arranged at an angle relative to an adjacent end of the plurality of heat exchange tubes.

3. The heat exchanger of claim 2, wherein the angle of the at least one opening of the plurality of openings relative to the plurality of heat exchange tubes is between about 60 degrees and about 120 degrees.

4. The heat exchanger of claim 1, wherein the at least one of the plurality of openings is oriented such that a heat exchange fluid passes through the at least one opening in a direction opposite a direction of an air flow across the plurality of heat exchange tubes.

5. The heat exchanger of claim 1, wherein the plurality of openings is axially spaced such that the plurality of openings is offset from the plurality of heat exchange tubes.

6. The heat exchanger of claim 1, further comprising an inlet for directing a heat exchange fluid into the distributor, the inlet having a generally angular contour that creates a pressure drop in the heat exchange fluid as it passes through the inlet.

7. The heat exchanger of claim 6, wherein the inlet has a bell-curve shape.

8. The heat exchanger of claim 1, wherein the flow restricting element additionally includes a dividing plate coupled to the distributor.

9. The heat exchanger of claim 8, wherein the bend region is formed at an interface between the first volume and the second volume, and a first portion of the flow restricting element is arranged within the first volume, and a second portion of the flow restricting element is arranged within the second volume.

10. The heat exchanger of claim 1, further comprising another flow restricting device arranged within the first header.

11. The heat exchanger of claim 10, wherein the first header includes at least a first volume and a second volume, and the another flow restricting element is arranged within the first volume of the first header.

12. The heat exchanger of claim 11, wherein the first volume of the first header receives a liquid heat exchange fluid.

13. The heat exchanger of claim 1, wherein the heat exchanger is a component of a heat pump.

14. The heat exchanger of claim 1, wherein the heat exchanger has a multi-pass configuration such that a first portion of the plurality of heat exchange tubes is coupled to the first volume and form a first fluid pass of the heat exchanger and a second portion of the plurality of heat exchange tubes is coupled to the second volume and form a second fluid pass of the heat exchanger.

* * * * *